US007611376B2

(12) United States Patent
Daily et al.

(10) Patent No.: US 7,611,376 B2
(45) Date of Patent: Nov. 3, 2009

(54) LED SOCKET

(75) Inventors: Christopher George Daily, Harrisburg, PA (US); John Michael Landis, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/943,356

(22) Filed: Nov. 20, 2007

(65) Prior Publication Data

US 2009/0130889 A1 May 21, 2009

(51) Int. Cl.
*H01R 4/24* (2006.01)

(52) U.S. Cl. ..... 439/419; 439/617; 439/620.02

(58) Field of Classification Search ..... 439/356, 439/419, 425, 617, 620.02, 620.21, 682, 439/683

See application file for complete search history.

(56) References Cited

U.S. PATENT DOCUMENTS 5,330,368 A * 7/1994 Tsuruzono ..... 439/409
5,558,543 A * 9/1996 Takano et al. ..... 439/699.2
5,944,463 A * 8/1999 Savage, Jr. ..... 439/419
6,017,241 A * 1/2000 Komai ..... 439/419
6,328,593 B1 * 12/2001 Chang et al. ..... 439/419
6,467,942 B2 * 10/2002 Alloway et al. ..... 362/549
6,974,347 B1 * 12/2005 Lin ..... 439/425
7,090,529 B1 8/2006 Wang
7,217,012 B2 * 5/2007 Southard et al. ..... 362/391
7,284,895 B2 * 10/2007 Goto ..... 362/645
2006/0082315 A1 4/2006 Chan

FOREIGN PATENT DOCUMENTS

GB 2 429 514 2/2007
WO WO 2007/047398 4/2007

* cited by examiner

*Primary Examiner*—Thanh-Tam T Le

(57) ABSTRACT

An LED electrical connector is attachable to a display panel or surface. The LED connector includes a housing having a base, a backplate, and a contact arrangement. The base and backplate form a housing for the contact arrangement and a channel for a cable. The base has a collar to receive an LED, with apertures for the LED contact legs. The contact arrangement includes a first contact having points, and a first terminal in common with the points. The first terminal engages the anode or cathode leg of the LED. A second contact has points and a second terminal interconnected to the points by a resistor. The second terminal configured to frictionally engage an anode or cathode leg. The first and the second contact points pierce insulation on the electrical cord to electrically engage the respective conductors of the cable, to energize the LED.

14 Claims, 3 Drawing Sheets

LED SOCKET

FIELD OF THE INVENTION

The present invention is directed to an LED socket and more specifically, an LED socket that is attachable to a display panel.

BACKGROUND OF THE INVENTION

LEDs are small light bulbs that fit easily into electrical circuits. Conventional incandescent bulbs contain a filament, which eventually burns out. The incandescent bulbs also emit high temperatures, posing a potential fire risk. Unlike conventional incandescent light bulbs, LEDs do not include a filament. LEDs are illuminated by the movement of electrons in a semiconductor material, and have a longer useful life, comparable with that of a transistor. In addition, LEDs are available in various colors such as red, orange, amber, yellow, green, blue and white. Further, LEDs are available in a variety of sizes and shapes.

LEDs having circular cross-section are common and are easy to install on electrical enclosures by drilling, punching or molding an opening suitable for the diameter of the LED. Adhesive may be used to secure the LED in its socket or soldered to PCBs. LED clips may also be used to secure LEDs in position. LEDs are also available in cross-section shapes that are square, rectangular or triangular. A variety of colors, sizes and shapes of LEDs are available. LEDs also vary in their viewing angle. The viewing angle defines the beam spread of the emitted light. Standard LEDs have a viewing angle of 60° but others have a narrower, more focused beam of 30° or less.

It is desirable to mount light emitting diodes (LEDs) in various locations to provide lighting effects because of their variety and versatility. An LED is an appropriate illumination source for a theatre curtain, because of the low heat dissipated during illumination and because of the extended operational life span. Therefore, there is a need for an LED socket for attaching an LED to a display. Other features and advantages of the present invention will be apparent from the following more detailed description of the preferred embodiment, taken in conjunction with the accompanying drawings which illustrate, by way of example, the principles of the invention.

SUMMARY OF THE INVENTION

The present invention is directed to an LED electrical connector. The LED connector includes a housing portion having a base portion, a backplate portion, and a contact arrangement. The base portion and backplate portion are detachably coupled to form a hollow interior for housing the contact arrangement and a channel for receiving an electrical cable. The base portion has a collar portion disposed on a first surface for receiving an LED, a pair of apertures for receiving a pair of LED contact legs, and latching arms for coupling to the backplate portion. The contact arrangement includes a first contact portion having points formed thereon, and a first mating terminal electrically in common with the points. The first mating terminal frictionally engages one of the anode or cathode legs of the LED. A second contact portion has points formed thereon and a second mating terminal interconnected to the points by a resistor. The second mating terminal configured to frictionally engage one of an anode and a cathode legs of the LED. wherein the first contact portion points and the second contact portion points pierce an insulating jacket of the electrical cord to electrically engage a first conductor and second conductor of the cable, to energize the LED.

The present invention is also directed to any application where a string of LEDs would be required.

An advantage of the present invention is the capability to mount an LED or multiple LEDs on a display.

Another advantage of the present invention is the ability to terminate multiple sockets to the same power cord to create an emitted light pattern with the multiple LEDs.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
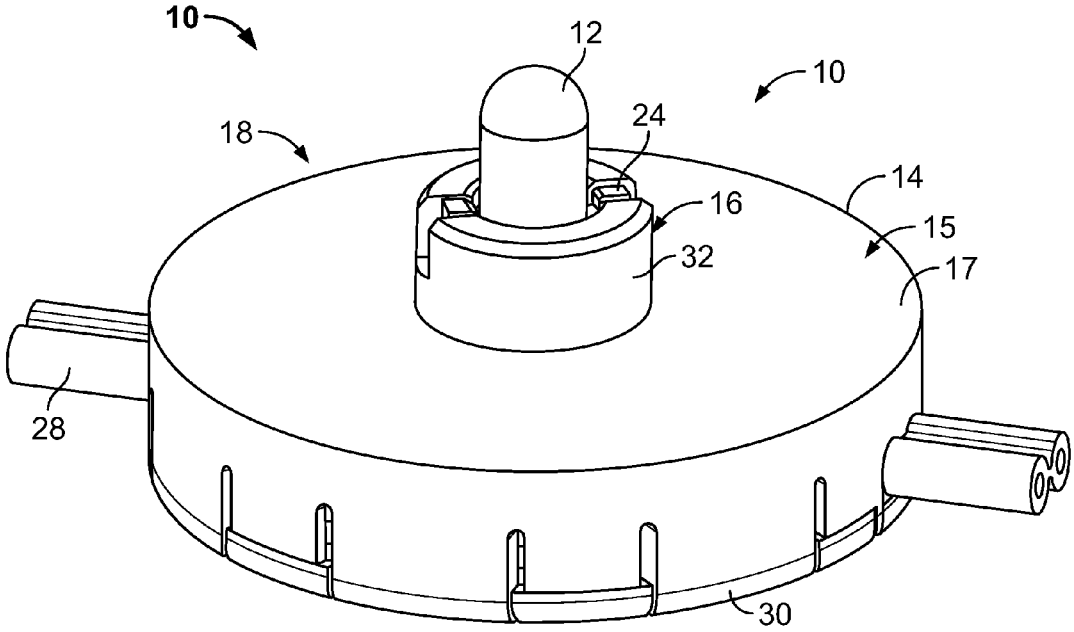
FIG. 1 is a perspective view of the LED socket.
Figure 2:
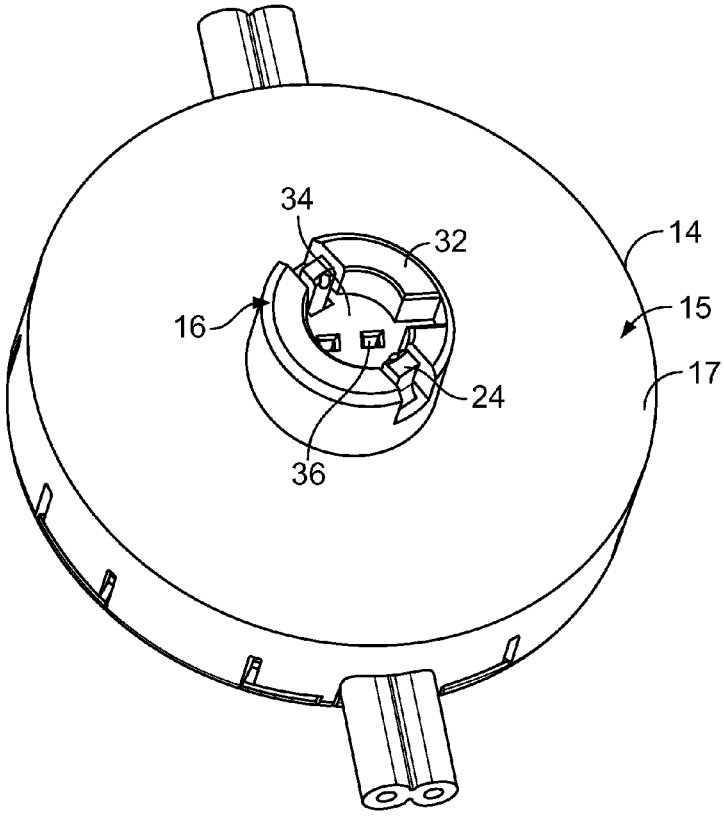
FIG. 2 is a top plan view of the exterior of the base portion.
Figure 3:
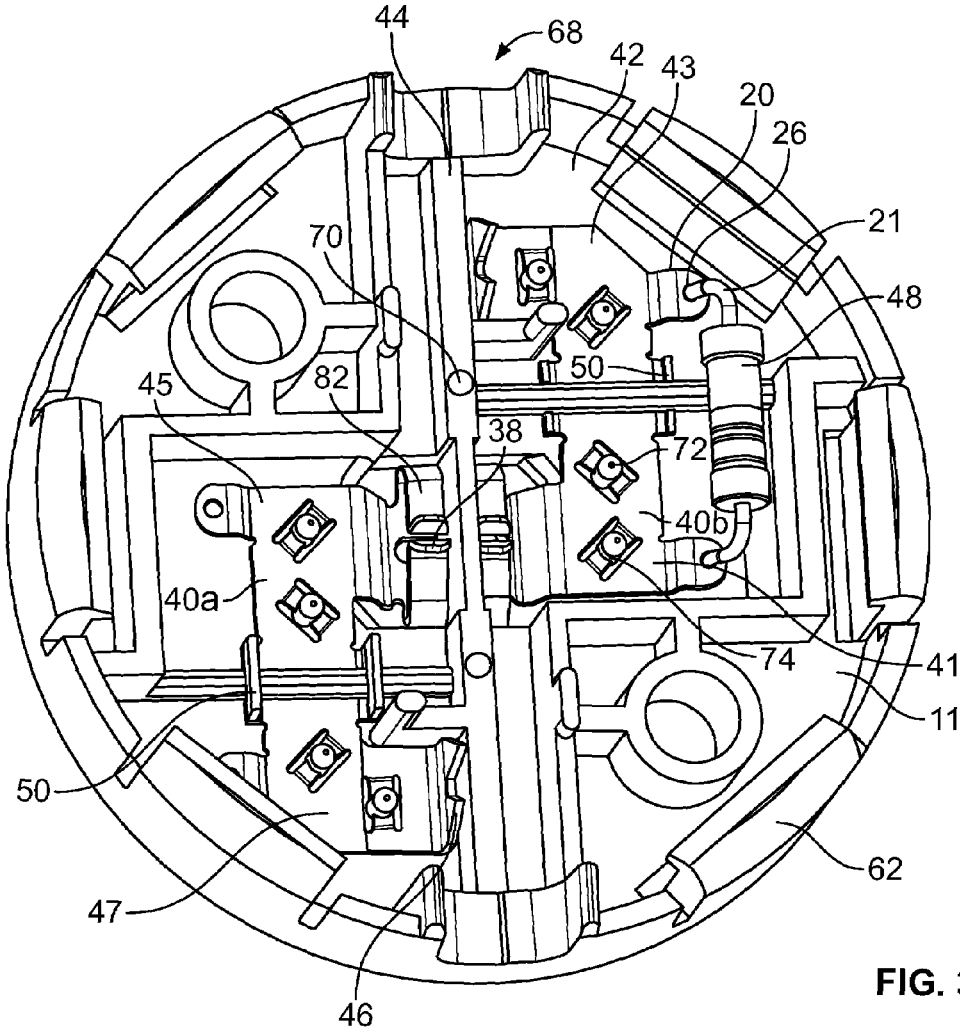
FIG. 3 is a side view of the base portion.
Figure 4:
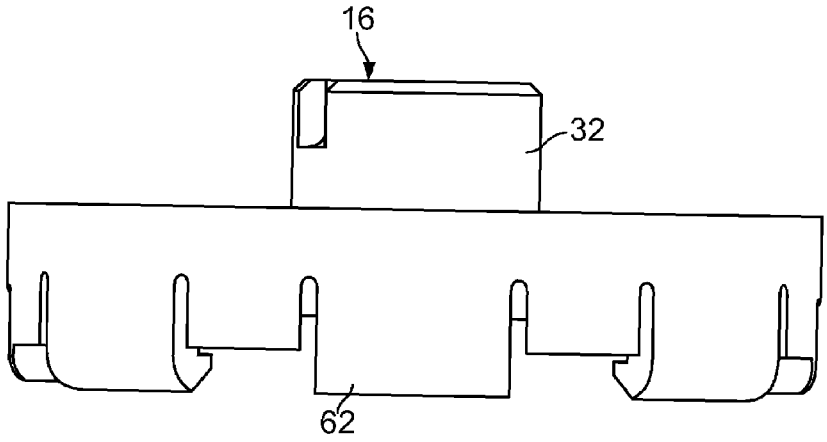
FIG. 4 is a plan view of the interior of the base portion.
Figure 5:
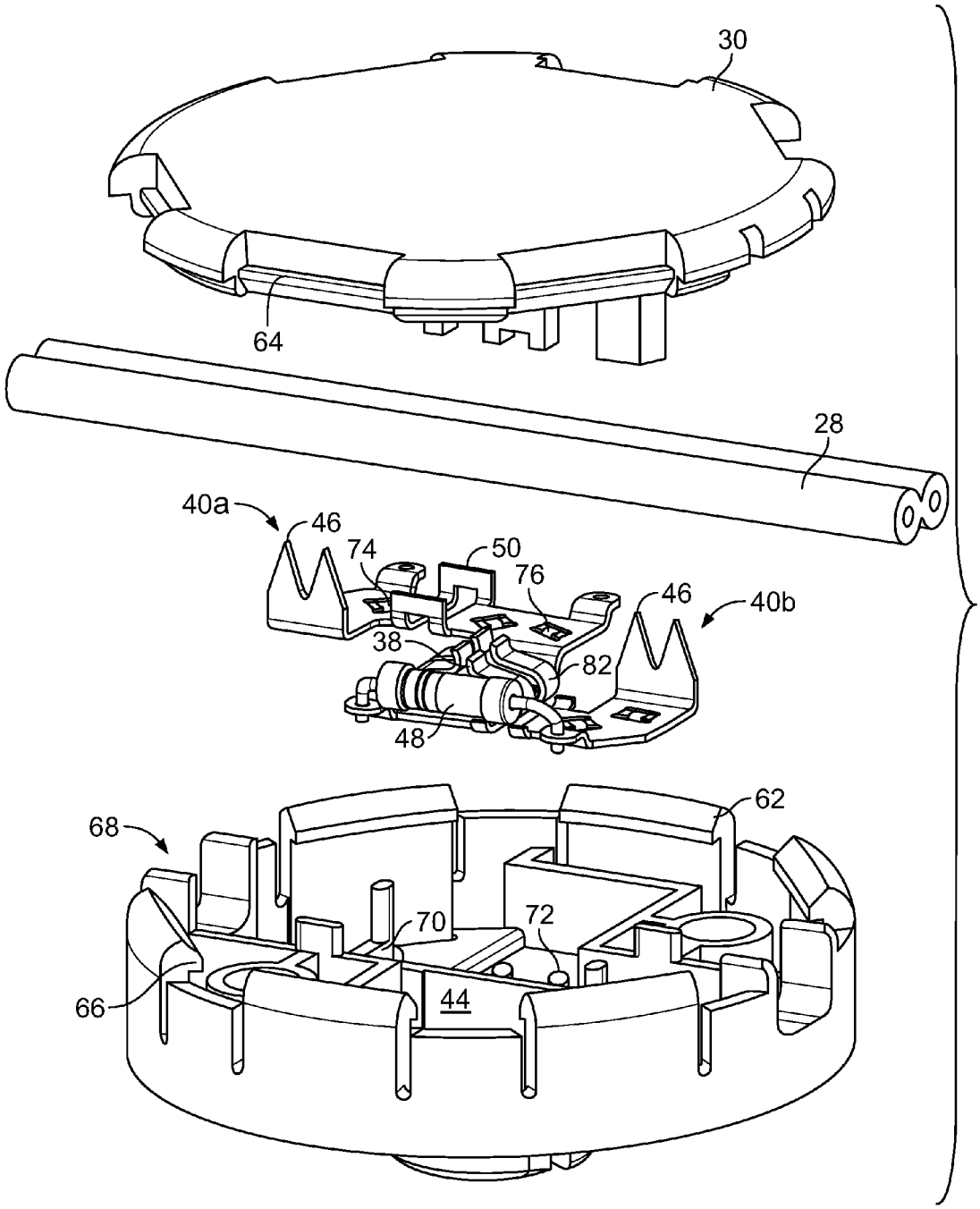
FIG. 5 is an exploded view of the LED socket.

FIG. 1 illustrates the LED socket 10 for mounting an LED 12. The socket 10 may be mounted, e.g., on a surface of a board, or other display medium. The socket has a base portion 14 with a raised collar 16 centrally disposed thereon. Adhesive may be applied to the exterior surface 17 of the base portion 14, for example, for mounting the LED socket to the board or display medium. Alternately, other fasteners may be used to secure the LED socket. The base portion 14 and the back plate 30 are detachably assembled to form an enclosed housing 18. A multiconductor cord 28 consisting of two insulated conductor wires, extends through the center of the housing 18 to engage a pair of contact legs of the LED 12, as will be presently explained. The LED 12 is insertable in the collar 16, where an electrical connection is made to the circuitry. The LED 12 is held in place in the collar 16 by detents 24 that flex and snap over an edge or flange on the bottom of the LED 12. Alternately, the LED 12 may be a flange-less type of LED that is maintained in position without using a detent 24, e.g., by friction fit between the LED socket 10 and the contact legs of the LED 12. The LED socket 10 shown in the figures is generally circular in a plan view, however the LED socket 10 typically include a flat side for proper polarization take other suitable shapes, e.g., octagonal, rectangular, elliptical, etc., as are know to those skilled in the art.

Referring now to FIGS. 2 through 5, the collar 16 has wall portion 32 defining a cavity 34 for receiving an LED 12. The collar 16 may be flush with the top surface 17 of the base portion, or may be raised to accommodate a thickness associated with the display medium to which the LED socket 10 is to be applied. A pair of slots 36 are formed in the bottom of the cavity 34 to accept the connection terminals, i.e., anode and cathode of the LED 12 (not shown) and align the terminals with a pair of mating terminals 38 disposed in the base portion interior 11. The mating terminals 38 are incorporated in a pair of contact portions 40*a*, 40*b* that attach to the bottom surface 42 of the base portion 14. The mating terminals 38 may be opposing bent metal members 82 with a gap between for frictionally engaging the LED 12 anode and cathode legs. The contact portions 40*a*, 40*b* are made of electrically conductive metal, and are electrically isolated from each other by a divider wall 44 of electrical insulating material, e.g., a non-conductive polymer. Each contact portion 40*a*, 40*b*, has barbs 46 that project upward and penetrate the insulating jacket of cable 28 to provide electrical communication between the cable 28, the contact portions 40*a*, 40*b*, and the LED 12 when the electrical connector 10 is completely assembled. One of the contact portions, 40*b*, has a resistor 48 connected across two contact segments 41, 43. The contact segments 41, 43 are electrically isolated from each other except for the resistor 48, after removal of a jumper tab 50. The resistor 48 is attached to connector tabs 20 located on either side of jumper tab 50. Connector tab 20 has an aperture 26 inserting the resistor terminals 21. The jumper tab 50 may optionally include a notch scored along two edges. The notches provide a stress-relief breakaway point for easily removing the jumper tab 50, to isolate the contact segments 41, 43. It should be noted that a series resistance is commonly provided in an LED circuit to adjust the voltage and current levels to meet the operating parameters of the specific LED.

The resistor 48 provides resistance connected in series with an anode leg (not shown) of the LED 12. The jumper tab 50 on contact portion 40*b* is connected directly to the cathode (not shown) of the LED 12. The jumper tab 50 on contact portion 40*a* is left intact, since the contact segments 45, 47, are electrically common—i.e., no resistor is required in the cathode leg (not shown) of LED 12, although a resistor 48 may be inserted in the cathode leg if desired, and removing the tabs 50.

The base portion 14 and the backplate 30 clamp together to form a unitary electrical connector. Latching arms 62 are disposed at intervals about the periphery of the base portion. The arms 62 have a lip 66 that engages with a shelf portion 64 of the backplate 30 to compress the cable 28 between the backplate 30 and the base portion 14. The multiconductor cable 28 enters and exits the electrical connector 10 through opposing notches 68 arranged at diametrically opposing sides of base portion 14. The cable 28 passes through the electrical connector 10 along the top of the divider wall 44. The insulating jacket of the cable 28 is penetrated by the contact points 46, as discussed above. The top of the divider wall 44 may optionally include conical barbs 70 molded on the divider wall 44. The barbs 70 impinge on the insulating layer of the cable 28 to frictionally restrain the cable 28 from axial displacement once the backplate 30 and the base portion 14 are clamped in place. The bottom surface 42 includes studs 72 that cooperate with spring members 74 in apertures 76 to retain the contact portions 40*a*, 40*b* against the bottom surface 42. Spring members 74 are sufficiently flexible to bend when pressed down on the studs 72 and grip the studs without the contact portions 40*a*, 40*b* backing off of the studs 72.

In the manner described above, a multiconductor cable 28 may be strung along a rear surface of a display board or other apparatus, and a series of electrical connectors 10 attached to the cable 28, with the LED 12 facing the opposite surface such that the LED 12 protrudes through the display board to provide decorative or functional lighting appearing as points of light, with the remainder of the electrical connector 10 substantially concealed by the display board.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A light emitting diode (LED) electrical connector comprising:

a housing portion having a base portion and a backplate portion, and a contact arrangement, the base portion and backplate portion detachably coupled to form a hollow interior for housing the contact arrangement and a channel for receiving an electrical cable;

the base portion having a collar portion disposed on a first surface for receiving an LED, a pair of apertures for receiving a pair of contact legs of the LED, and at least one latching arm for coupling to the backplate portion;

the contact arrangement comprising:

a first contact portion having one or more points formed thereon, and a first mating terminal electrical common with the one or more points, the first mating terminal frictionally engaging one of an anode and a cathode of the LED; and a second contact portion having one or more points formed thereon and a second mating terminal interconnected to the one or more points by a resistor, the second mating terminal configured to frictionally engage one of an anode and a cathode of the LED;

wherein the first contact portion points and the second contact portion points penetrate an insulating jacket of the electrical cable to electrically engage a first conductor and second conductor of the cable, to energize the LED; and wherein the second contact portion further includes a first contact segment and a second contact segment, the first contact segment and the second contact segment being connected in series through the resistor.

2. The connector of claim 1, wherein the LED is removably secured in the collar by a first pair of flexible detents configured to engage an edge portion of the LED.

3. The connector of claim 1, wherein the first mating terminal and the second mating terminal are comprised of opposing bent metal members defining a gap therebetween for frictionally engaging the LED anode and cathode legs.

4. The connector of claim 1, wherein the first contact portion and the second contact portion are comprised of electrically conductive metal, the first contact portion and the second contact portion being electrically isolated by an insulating divider wall disposed within the base portion.

5. The connector of claim 4, wherein each contact portion of the first contact portion and the second contact portion includes a plurality of projecting points configured to penetrate the insulating jacket of a predetermined thickness to engage an electrical conductor, to provide electrical communication between the conductor, the first contact portion and the second contact portion, and the LED when the electrical fixture is fully assembled.

6. The connector of claim 1, wherein the base portion further includes a plurality of arm portions depending from a periphery of the base portion, each arm portion of the plurality of arm portions including a lip that engages with a shelf portion of the backplate portion.

7. The connector of claim 6, wherein the base portion and backplate portion compress the electric cable therebetween when the lips of each portion of the plurality of arm portions are engaged with the shelf portions, and wherein the electric cable passes through a pair of opposing notches arranged at diametrically opposing sides of base portion.

8. The connector of claim 7, wherein the base portion further includes a divider wall, the divider wall arranged adjacent to the cable passing through the notches.

9. The connector of claim 8, wherein the divider wall includes a top surface and conical barbs projecting upward therefrom, the conical barbs arranged to impinge on the insulating layer of the cable to restrain the electrical cable from axial displacement after the backplate portion and the base portion are coupled by the plurality of latching arms.

10. The connector of claim 1, wherein the base portion further includes a bottom surface and a plurality of stud members, and the first contact portion and the second contact portion include an aperture with at least one spring member disposed therein, the at least one spring member being configured to frictionally engage the stud members and retain the contact portions on the bottom surface.

11. The connector of claim 10, wherein the spring members are flexible when pressed against the stud members to grip the stud members to prevent the contact portions from backing from the stud members.

12. A contact arrangement for use in a light emitting diode (LED) connector having a housing portion having a base portion and a backplate portion detachably coupled to form a hollow interior for housing the contact arrangement and a channel for receiving an electrical cable, the contact arrangement comprising:

a first contact portion having one or more points formed thereon, and a first mating terminal electrical common with the one or more points, the first mating terminal frictionally engaging one of an anode and a cathode of the LED; and a second contact portion having one or more points formed thereon and a second mating terminal interconnected to the one or more points by a resistor, the second mating terminal configured to frictionally engage one of an anode and a cathode of the LED;

wherein the first contact portion points and the second contact portion points penetrate an insulating jacket of the electrical cable to electrically engage a first conductor and second conductor of the cable, to energize the LED; and wherein the second contact portion further includes a first contact segment and a second contact segment, the first contact segment and the second contact segment being connected in series through the resistor.

13. The contact arrangement of claim 12, wherein each contact portion of the first contact portion and the second contact portion includes a plurality of projecting points configured to penetrate the insulating jacket of a predetermined thickness to engage an electrical conductor, to provide electrical communication between the conductor, the first contact portion and the second contact portion, and the LED when the electrical fixture is fully assembled.

14. The contact arrangement of claim 12, wherein each of the first contact portion and the second contact portion includes a removable tab portion, the tab portion providing electrical connectivity between the first contact portion and the second contact portion.

* * * * *